United States Patent [19]

Peterman

[11] Patent Number: 4,770,475

[45] Date of Patent: Sep. 13, 1988

[54] ANTI TIP SHOE

[75] Inventor: Robert J. Peterman, Hartland, Wis.

[73] Assignee: Spacesaver Corporation, Fort Atkinson, Wis.

[21] Appl. No.: 920,183

[22] Filed: Oct. 17, 1986

[51] Int. Cl.[4] ..... A47B 53/00

[52] U.S. Cl. ..... 312/201; 312/198; 312/250; 312/317 R

[58] Field of Search ..... 312/201, 317 A, 198, 312/199, 200, 250, 311, 317 R, 273; 104/242, 243, 248, 245, 246; 297/310

[56] References Cited

U.S. PATENT DOCUMENTS 3,912,350 10/1975 Gurubatham ..... 312/317 R 4,618,191 10/1986 Peterman ..... 312/201

*Primary Examiner*—Peter A. Aschenbrenner

*Assistant Examiner*—Thomas A. Rendos

*Attorney, Agent, or Firm*—Fuller, Puerner & Hohenfeldt

[57] ABSTRACT

A mobile storage system is provided with safety devices that increase the stability of the movable carriages. The safety devices includes shoe plates mounted to the carriages proximate each carriage wheel and above the rails. A nylon shoe is attached to the bottom of each shoe plate near the rail. The shoe plates are adjustable to position the shoe with minimum running clearances with the rails. Only a small amount of initial tipping causes the shoes to contact the rails and support a carriage against further tipping. The increased spread between the anti tip shoes compared with the spread between the wheels provides increased resistance to overturning forces by the square of the ratio of the spreads.

2 Claims, 1 Drawing Sheet

ANTI TIP SHOE

BACKGROUND OF THE INVENTION

1. Field of the Invention

This invention pertains to safety devices, and more particularly to apparatus for increasing the safety of mobile storage systems.

2. Description of the Prior Art

The use of mobile storage systems to conserve valuable floor space in offices, factories, and warehouses is widespread. Mobile storage systems typically include movable carriages that are relatively long and high in relation to their width in the direction of movement along the system rails. Consequently, the possibility exists that, under certain extreme conditions, a top heavy or eccentrically loaded carriage may tip in the direction of motion.

Various equipment has been developed to reduce or eliminate the possibility of carriage tipping. In one type of design, the longitudinal distance between the carriage wheels is increased to a practical maximum. The increased wheel spread increases the carriage stability by creating an increased moment arm for resisting overturning forces.

A second type of design for preventing the tipping of movable carriages employs rigid interfitting members on the carriage and the system rails. Normally, a running clearance exists between the carriage and rail members. However, should the carriage start to tip, the carriage member contacts and is restrained by the rail member against further tipping. U.S. Pat. No. 4,618,191 discloses a satisfactory anti tip device of the second type. Although the prior anti tip designs have given good results, they possess certain disadvantages related to cost and manufacture.

Overhead style anti tip devices are also known. Those designs require several inches of overhead space, however, which is a great disadvantage.

Thus, a need exists for an improved design for increasing the stability of mobile storage system movable carriages.

SUMMARY OF THE INVENTION

In accordance with the present invention, an inexpensive anti tip device is provided that greatly increases the safety of mobile storage systems. This is accomplished by apparatus that includes nylon shoes that are adjustably mounted to the system carriages in close proximity to the rails.

A shoe plate is mounted over each system rail proximate each carriage wheel; thus, a carriage has at least four shoe plates. Each shoe plate is mounted to the carriage by means of a pair of fixed screws. An eccentric adjusting shaft adjusts the vertical location of the shoe plate on the carriage. A nylon shoe is attached to the lower end of each shoe plate and in close proximity to the rail. The adjustment feature of the shoe plates permits positioning the shoes very slightly above the rail. Consequently, the shoes will contact the rail and the shoe plates will support the carriage after only a very slight amount of tipping. The nylon material produces only a minimum amount of friction should a moving shoe contact the rail, and the nylon does not damage the rail.

Other objects, aims, and advantages of the invention will become apparent upon reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structures. The scope of the invention is defined in the claims appended hereto.

Figure 1:
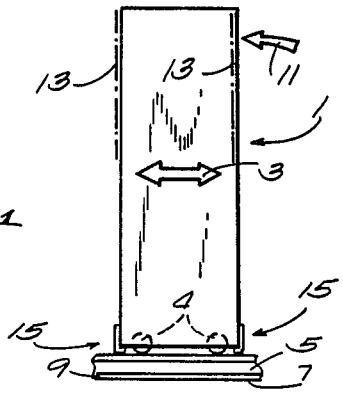
FIG. 1 is an end view of a typical mobile storage system movable carriage that includes the present invention.
Figure 2:
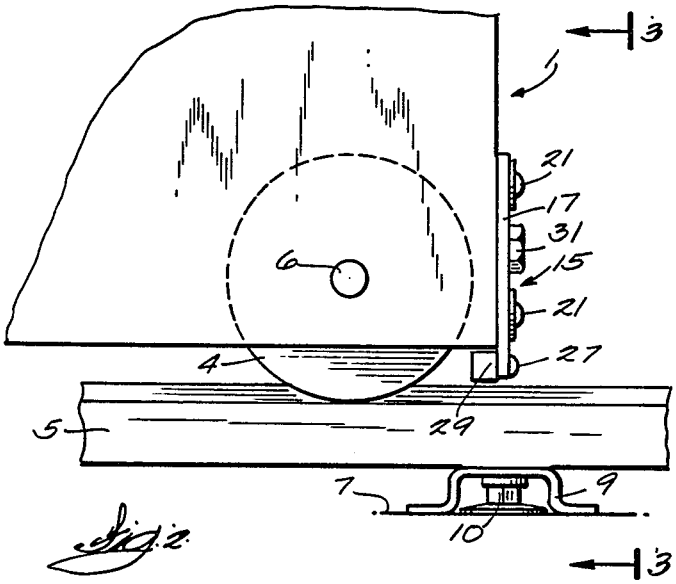
FIG. 2 is an enlarged end view of a lower corner of a movable carriage that is equipped with the present invention.
Figure 3:
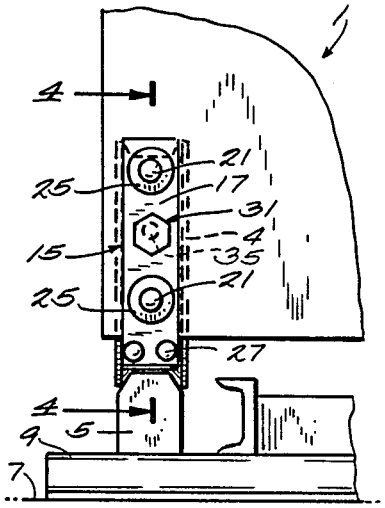
FIG. 3 is a view taken along lines 3—3 of FIG. 2.

Referring to FIGS. 1–3, a movable carriage 1 is illustrated that includes the present invention. The movable carriage is normally employed in conjunction with other similar carriages and fixed units in a mobile storage system. However, it will be understood that the invention is not limited to movable storage applications.

The carriage 1 is supported for longitudinal movement in the direction of arrows 3 by wheels 4 and axles 6. The wheels 4 roll along parallel rails 5. Longitudinal movement in the direction of arrows 3 may be accomplished by conventional manual or power means, as is known in the art. The rails 5 are supported above the building floor 7 by a frame 9. A suitable frame 9, which includes leveling screws 10, is disclosed in U.S. patent application Ser. No. 766,249.

As best shown in FIG. 1, the carriage 1 is relatively high in relation to its width in the longitudinal direction 3. As a result, under extreme conditions, an obstacle placed in the path of a top heavy or eccentrically loaded carriage may produce an inertia force 11 that causes the carriage to tip, as is illustrated by the phantom lines 13.

Figure 4:
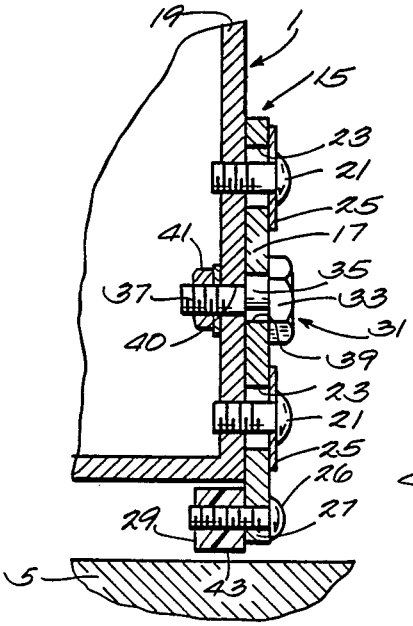
FIG. 4 is a cross sectional view taken along lines 4—4 of FIG. 3.

In accordance with the present invention, the stability of a movable carriage 1 in the longitudinal direction 3 is greatly increased by the use of anti tip shoes 15. An anti tip shoe 15 is mounted to the carriage outboard of each wheel 4 and over the corresponding rail 5. Referring to FIGS. 2–4, each anti tip shoe comprises a generally rectangular shoe plate 17. Each shoe plate 17 is mounted in a vertical orientation to the outside of the carriage frame 19 by means of screws 21. The screws 21 may be self-tapping, if desired. Large clearance holes 23 are machined in the shoe plates, and washers 25 are placed under the screw heads. Alternately, longitudinally extending slots may be employed to give vertical clearances around the screws. The lower end 27 of each shoe plate extends below the bottom of the carriage frame 19. Attached to the shoe plate lower end, as by a screw 26, is a nylon shoe 29.

To adjust the position of the shoe 29 in relation to the rail 5, an eccentric adjusting shaft 31 is provided. The eccentric adjusting shaft 31 includes a head 33, a shoulder 35, and a threaded end 37. The shoulder 35 has an axis that is non-concentric with the axis of the threaded end 37. The shoulder closely fits within a through hole 39 in the shoe plate 17. The eccentric adjusting shaft threaded end 37 is received within a hole 40 in the carriage and is retained by a nut and washer 41.

To set the nylon shoes 29 in proper relation to the rails 5, the screws 21 are loosened. Turning the eccentric adjusting shaft head 33 causes the shoe plate 17 to be correspondingly raised or lowered until the desired running clearance 43 is produced between the shoe and rail. The screws 21 are then tightened. The present invention permits very small clearances 43 to be established between the rails and shoes. Consequently, the carriages are positively supported after only a very small amount of initial tipping induced by the inertia force 11.

Because the anti tip shoes 15 of the present invention are placed outboard of the wheels 4, the longitudinal spread between the shoes 29 is greater than the spread between the corresponding wheels. Consequently, the rotational resistance to carriage tipping provided by the positive supports of the anti tip shoes is increased over the tipping resistance provided by the wheels. The rotational resistance to tipping is proportional to the square of the distance between the shoes according to the formula $Kr=\frac{1}{2}\times Kw\times L^2$, where Kr is the rotational resistance to tipping, Kw is the resistance to vertical motion at the shoes under the influence of the inertia force, and L is the distance between the shoes.

Accordingly, a relatively small increase in spread between the shoes compared with the spread between the wheels can produce a relatively large increase in resistance to carriage tipping. As a consequence, carriage safety and stability are correspondingly increased.

Thus, it is apparent that there has been provided, in accordance with the invention, an anti tip shoe that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. In a mobile storage system having at least two longitudinal rails supported on a building floor, at least one movable carriage comprising:

a. a carriage frame;

b. a pair of wheels in rolling contact with each rail and mounted for rotation to the carriage frame to support the carriage for longitudinal movement along the rails;

c. a shoe plate mounted to the carriage frame proximate each wheel and over the corresponding rail, the shoe plate having a lower end that terminates a short distance above the rail;

d. a shoe attached to each shoe plate lower end; and e. adjustment means for adjusting the position of the shoes relative to the rails, wherein the adjustment means comprises an eccentric adjusting shaft having an end received in the carriage frame and an eccentric shoulder received by the shoe plate, so that rotating the eccentric adjusting shaft changes the vertical position of the shoe plate and shoe on the carriage relative to the rails.

2. Apparatus for increasing the safety of a movable carriage supported for rolling longitudinally along parallel rails by a pair of wheels in contact with each rail comprising:

a. a shoe plate mounted to the carriage outboard of each wheel and over the corresponding rail;

b. a shoe attached to each shoe plate in close proximity to the respective rails; and c. adjustment means for vertically positioning the shoes to desired running clearances with the respective rails, wherein the adjustment means comprises an eccentric adjusting shaft having an end received in the carriage and a shoulder eccentric with the end, the shoulder being received in a hole through the shoe plate, so that rotating the eccentric shaft about the end received in the carriage produces vertical motion of the shoe plate and shoe to thereby adjust the shoe position relative to the rail.

* * * * *